United States Patent [19]

Ward et al.

[11] 3,991,986

[45] Nov. 16, 1976

[54] FLUID QUENCH HOUSING ASSEMBLY WITH EXTERNAL FLOW ADJUSTMENT

[75] Inventors: George C. Ward, Carrollton, Ga.; William Gernetzke, deceased

[73] Assignee: Southwire Company, Carrollton, Ga.

[22] Filed: Jan. 27, 1975

(Under Rule 47)

[21] Appl. No.: 544,277

[52] U.S. Cl. ..... 266/112; 134/64 R

[51] Int. Cl.[2] ..... C21D 9/52

[58] Field of Search ..... 251/349, 353; 74/55; 118/405; 134/64 R, 122 R; 266/3 R, 3 P, 4 S, 6 R, 6 S, 111, 112

[56] References Cited

UNITED STATES PATENTS

| | | | |
|---|---|---|---|
| 2,229,951 | 1/1941 | West et al. | 74/55 |
| 2,542,237 | 2/1951 | Dewey | 134/122 R |
| 3,270,364 | 9/1966 | Steele | 134/122 R |
| 3,561,399 | 2/1971 | Federman | 118/405 X |
| 3,793,894 | 2/1974 | Greskovics | 74/55 |
| 3,806,366 | 4/1974 | Cofer et al. | 266/3 R X |
| 3,882,819 | 5/1975 | Skeeters | 118/405 |

*Primary Examiner*—Roy Lake
*Assistant Examiner*—Paul A. Bell
*Attorney, Agent, or Firm*—Van C. Wilks; Herbert M. Hanegan; Stanley L. Tate

[57] ABSTRACT

Apparatus for providing an adjustable flow of quenching fluid to a traveling rod or the like. The rod travels through a quench housing assembly having a fixed valve surface surrounding the path of travel of the rod. A movable valve member having an internal passage aligned with the direction of rod travel is supported within the housing assembly for a limited extent of axial travel, and the movable valve member provides a valve surface which is in confronting relation to the fixed valve surface. A cam engages a slot on an exterior surface of the movable valve member. The cam is connected to a cam shaft which extends to a location outside of the housing assembly. The cam, when rotated by the cam shaft, axially moves the valve member to adjust the fluid flow aperture defined by the confronting valve surfaces.

8 Claims, 2 Drawing Figures

FLUID QUENCH HOUSING ASSEMBLY WITH EXTERNAL FLOW ADJUSTMENT

This invention relates in general to fluid quenching apparatus, used in the manufacture of hot-rolled metal rod, and in particular to fluid quenching apparatus permitting adjustment of the quenching fluid flow rate without interruption of the manufacturing operation.

The manufacture of hot-rolled metal rod typically involves one or more operations in which the heated rod is subjected to a surrounding atmosphere of a liquid or gaseous fluid for one or more purposes. Those skilled in the art of manufacturing hot-rolled copper or copper alloy rod, by way of example, will recognize the desirability of pickling the rod by exposing the rod surface to contact with an acidic solution which removes scale from the surface of the rod. A heated metallic rod may also be subjected to a surrounding fluid flow for the purpose of cooling the heated rod, as well as for other purposes which are not mentioned herein. Fluid quenching or cooling of heated rod typically takes place while the rod is traveling through a conduit of inner diameter which is greater than the outer diameter of the rod. The desired liquid or gaseous quenching liquid is injected into the guide conduit at a fluid entry location which is customarily located where the traveling rod exits the conduit, and the quenching fluid flows within the conduit to a suitable fluid exit location which is customarily located where the rod enters the conduit.

Various types of apparatus have been developed for introducing or injecting a flow of fluid into a rod guide conduit. Such apparatus typically, although not necessarily, utilizes nozzle structure of various designs, for the purpose of imparting fluid flow in a desired direction along the interior of the rod conduit. Since it is frequently desirable to adjust the volume, the velocity, and the pressure of fluid within the rod tube, it is also desirable that the fluid flow area of a nozzle in fluid injection apparatus be adjustable over a range of nozzle area. One such apparatus for injecting quenching fluid is shown in U.S. Pat. No. 3,623,532, and is seen to include an adjustable nozzle insert having a threaded connection with a fixed member of the quench housing assembly. The size of the injection nozzle opening is varied by rotating the nozzle member. Since the threaded nozzle member is entirely contained within the quench housing assembly, because of the necessity that the nozzle member be axially aligned with the path of rod travel, it is impossible to adjust the nozzle opening of the aforementioned prior-art fluid injection apparatus without completely shutting down the quenching operation, opening the quench chamber, making an estimated adjustment of the threaded nozzle, reclosing the quench chamber, and again starting the quenching operation. It will be understood that adjustment of the foregoing prior-art nozzle is time-consuming and, at best, is unlikely to provide more than an approximation of desired nozzle opening.

It has been proposed to adjust the flow of quenching fluid simply by adjusting an external valve in the supply of quenching fluid to a fluid injection apparatus. Such adjustment of the fluid supply cannot independently adjust the velocity and the volume of the fluid at the point of introduction into the rod conduit.

Accordingly, it is an object of the present invention to provide improved apparatus for fluid treatment of a heated rod.

It is another object of the present invention to provide improved apparatus for adjusting the flow of quenching fluid in a fluid quench assembly.

It is still another object of the present invention to provide rod fluid treating apparatus which is adjustable without interruption of or interference with the operation of the rod production operation.

Other objects and advantages of the present invention will become apparent from consideration of the disclosed embodiment, including the drawing in which the Figure shows a partially sectioned and broken-away view of fluid injection apparatus according to the disclosed embodiment of the present invention.

Stated in general terms, the fluid injection apparatus of the present invention includes a fluid flow valve having a valve member which surrounds the path of rod travel and which is slidably axially movable for adjustment simultaneously with travel of rod along the path. The valve member is surrounded by a housing which defines a fluid-introduction chamber, and a valve seat is disposed within the chamber in confronting relation with the valve member. A valve operating member extends from outside the housing into engagement with the slidable valve member, whereby the position of the slidable valve member with respect to the valve seat is controlled by movement of the operating means from outside of the housing. The relative axial position of the valve member determines the fluid flow area between the valve member and the fixed valve seat. The fluid-introduction chamber is supplied with fluid for rod quenching, cooling, or for any other desired purpose.

Figures 1, 2:
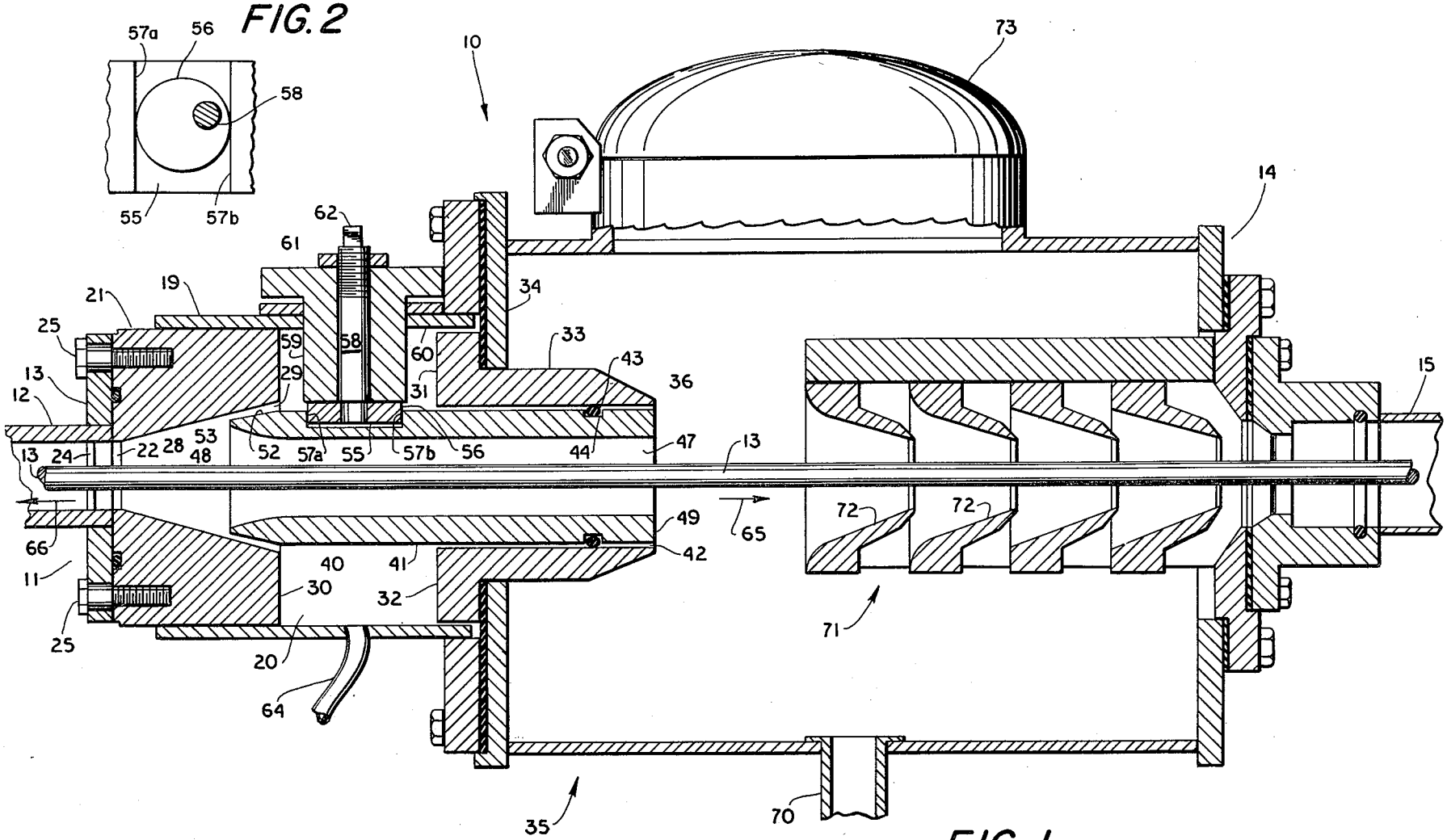
FIG. 1 is a sectioned overall elevation view of a disclosed embodiment of the present invention.
FIG. 2 is a sectioned top plan view showing details of the cam actuator for the valve member of the disclosed embodiment.

The present invention is better understood as described with respect to the disclosed embodiment of fluid injection apparatus shown generally at 10 in FIG. 1. It will be understood that the apparatus 10 is connected at a first end 11 to a rod conduit 12 which defines a path of travel for a rod 13 which is being propelled through the conduit by apparatus forming no part of the present invention. It will also be understood that the injection apparatus 10 has a second end 14 which may be connected to a rod conduit 15, which may be considered as a continuation of the rod conduit 12 and which serves to guide and conduct the rod 13 after leaving the fluid injection apparatus.

The apparatus 10 includes a housing 19 adjacent the first end 11, with the housing 19 enclosing and defining a fluid injection chamber 20. Secured within a first end of the housing 19 is a valve seat member 21 having a central opening 22 coaxially aligned with the rod conduit 12. An end plate 23 having an opening 24, which is coaxially aligned with the central opening 22 and the rod conduit 12, may be connected to the outer end of the valve seat member 21 by means of suitable fasteners such as the bolts 25 so as to provide a detachable interconnection between the rod conduit and the valve seat member.

The valve seat member 21 is configured to define a valve seat surface 28 which, in the disclosed embodiment, takes the form of a truncated cone extending from a narrow end contiguous to the central opening 22 to a wide end 29 terminating at the face 30 of the valve seat member which confronts and defines the fluid injection chamber 20. Although the particular disclosed configuration of the valve seat surface 28 provides a particular direction of injected fluid flow, as will become apparent, the herein-depicted configuration of the valve seat surface is but one such configuration which may be selected by those skilled in the art.

The surface 31 of the chamber 20 is provided by a flange 32 surrounding and integrally formed with the valve receiving tube 33, which extends in a direction away from the fluid injection chamber 20. The flange 32 of the valve receiving tube 33 is fastened to a wall 34 of a fluid receiving housing indicated generally at 35, with the valve receiving tube 33 extending within the housing 35 through an aperture in the wall 34. The valve receiving tube 33 defines a cylindrical interior passage 36 which is coaxial with the nominal path along which the rod 13 travels.

Receiving within the cylindrical interior passage 36 of the valve receiving tube 33 is a valve member 40 having a cylindrical exterior surface 41 the diameter of which is selected to provide a snug sliding slip joint 42 within the cylindrical interior passage 36. An O-ring seal 43 received in the peripheral slot 44 of the exterior surface 41 maintains fluid-tight sealing along the sliding slip joint 42.

The valve member 40 has an internal passage 47 which extends from a first end 48 to the second end 49 of the valve member. The internal passage 47 is preferably cylindrical and is coaxial with the path of travel of the rod 13.

A valve surface 52 is provided on the valve member 40 in proximate relation with the first end 48 thereof. The valve surface 52, which confronts the valve seat surface 28 of the member 21, preferably has a configuration which is complementary to the confronting surface 28; the valve surface 52 in the disclosed embodiment is the shape of a truncated cone. The annular region 53 between the confronting surfaces 52 and 28 provides a fluid flow passage between the fluid injection chamber 20 and the interior of the rod conduit 12.

A slot 55 is machined or otherwise provided at a location in the exterior surface 41 of the valve member 40, and a cam 56 is positioned within the slot. The cam 56 and slot 57 are preferably configured as shown in FIG. 2, so that contact is maintained between the cam and the sides 57*a*, 57*b* of the slot, at substantially all rotational positions of the cam.

The cam 56 is connected to a shaft 58 for rotation therewith. The shaft 58 passes through a bushing 59 which extends from proximate contact with the cam 56 to the inner wall surface 60 of the housing 19, and which functions to maintain the cam in desired position within the slot 55. The shaft 58 extends through suitable fluid-tight packing structure 61, which prevents pressurized fluid from escaping the chamber 20, and terminates at an outer end 62 which lies outside of the housing 19. The outer end 62 of the shaft 58 may be provided with an external surface suitable for engagement by a wrench or another tool, or may alternatively be provided with a handle.

The fluid injection chamber 20 is in fluid flow communication with a pipe 64, which may be connected to any desired source of liquid or gaseous fluid.

Considering the operation of the fluid injection apparatus as described thus far, it is assumed that the rod 13 is traveling through the injection apparatus in the direction indicated by the arrow 65, although the actual direction of rod travel is unimportant to the operation of the present apparatus. A supply of suitable fluid, such as an acidic pickling solution, is introduced into the fluid injection chamber 20 through the pipe 64, and the pressurized fluid within the chamber 20 flows through the annular passage 53. The annular passage 53, which in the disclosed embodiment takes the form of a truncated cone pointing toward the first end 11 of the injection apparatus, functions as a nozzle which directs a flow of pickling fluid in the counterflow direction indicated by the arrow 66. If it is desired to adjust the flow of pickling liquid by adjusting the area of the fluid passage 53, the cam 56 is rotated by turning the shaft 62 so that the valve member 40 axially slides along the sliding slip joint 42 in a direction determined by the rotation of the cam. It will be seen that the axial sliding movement of the valve member 40 increases or decreases the area of the fluid passage 53, thereby providing a corresponding increase or decrease in the flow of fluid which is injected into the rod conduit 12. The valve member 40 can, if desired, be designed to have an axial sliding position which substantially closes the fluid passage 53, thereby preventing injection of any fluid into the rod conduit 12, although the function of blocking fluid injection can alternatively be provided by inserting an appropriate valve in the pipe 64.

The fluid receiving housing 35 provides a chamber to receive and collect fluid backflow which may occur from either of the rod conduits 12 and 15. The housing 35 is preferably provided with a fluid drain line 70 to convey such collected fluid from the housing. The use of a fluid collection apparatus such as the housing 35 is desirable in applications such as rod pickling, where the fluid consists of an acidic solution which could damage people and equipment if allowed to escape indiscriminately from the fluid injection apparatus.

A rod guide structure 71 consisting of several guide sockets 72 is positioned within the housing 35 in coaxial relation with the rod conduit 15. The guide structure 71 serves to guide and support the rod 13 as the rod travels along a path through the housing 35. The housing 35 may be provided with a hatch cover 73 which is openable to permit inspection of the rod and cleaning of scale and other debris which may collect within the housing 35.

It will be apparent that the foregoing relates only to a disclosed preferred embodiment of the present invention, and that numerous alterations and modifications may be made therein without departing from the spirit and the scope of the invention as defined in the following claims.

What is claimed is:

1. Apparatus for fluid treatment of a traveling rod, comprising:

first means defining an enclosed fluid treatment passageway for the linear travel of an elongate rod;

second means mounted for linear slidable movement along the path of linear travel and defining a fluid injection aperture which communicates with said passageway in annular surrounding relation therewith; and third means engaging said second means and operable from outside of said enclosed passageway to slide said second means along said path of linear travel so as to vary the longitudinal extent of said annular injection aperture.

2. Apparatus as in claim 1, wherein:

said aperture defining second means comprises a first member and a second member each having a passage for the travel of rod;

said passages of said first and second members being coaxially aligned and axially spaced apart from each other;

means mounting one of said first and second members for sliding linear axial movement relative to the other of said members; and said operable third means being connected to impart said sliding coaxial movement to said one member.

3. Adjustable fluid injection apparatus, comprising:

a valve seat member defining a first rod passage through which an elongate rod can pass, and having a first surface annularly surrounding said first rod passage;

means defining a fluid receiving chamber in fluid communication with an end of said first rod passage;

a valve member positioned within said fluid receiving chamber;

said valve member having a second rod passage through which the rod can pass and also having a second surface congruent with said first surface and in annular surrounding relation with said second rod passage;

means supporting said valve member within said fluid receiving chamber to maintain said first rod passage in coaxial alignment with said second rod passage to maintain said valve member for axially slidable movement relative to said valve seat member; and operating means having a first portion which is accessible from outside said fluid receiving chamber and having a second portion which operatively engages said valve member inside said fluid receiving chamber to slidably move said valve member along said axis, so that the fluid flow area defined by the axial spacing between said congruent first and second rod passages can be adjusted by operating said first portion.

4. Apparatus as in claim 3, further comprising means in fluid flow communication with said valve chamber to introduce a quantity of fluid therein for entry into at least one of said first and second rod passages.

5. Apparatus as in claim 3, wherein:

said first and second surfaces form mutually confronting truncated conic surfaces, so that the distance between said conic surfaces determines said fluid flow area and is variable in response to said axial movement of said valve member.

6. Apparatus as in claim 3, wherein:

said second portion engaging said valve member comprises a cam member mounted for rotation and operatively engaging said valve member so that rotation of said cam member imparts said slidable axial movement to said valve member; and said first portion comprises cam rotating means operatively connected to said cam member and extending to a location outside of said fluid receiving chamber.

7. Apparatus as in claim 6, wherein said cam rotating means comprises a cam drive shaft connected to said cam and mounted for rotation on an axis which is substantially perpendicular to the axis of valve member movement, said drive shaft extending in fluid tight relation through said chamber defining means and terminating externally of said chamber.

8. Apparatus as in claim 3, wherein:

said valve member has a cylindrical exterior portion which is coaxial with said axis of movement; and further comprising means defining a cylindrical opening coaxial with said axis of movement and positioned to receive said cylindrical exterior portion of said valve member for said sliding axial movement.

* * * * *